US008091397B1

(12) United States Patent
Allen

(10) Patent No.: US 8,091,397 B1
(45) Date of Patent: Jan. 10, 2012

(54) COMPACT ROLL GROOVING APPARATUS WITH ADJUSTABLE MOUNTING AND EXTENDED BACKUP ROLLER SHAFT

(76) Inventor: Harold Allen, Fawnskin, CA (US)

( * ) Notice: Subject to any disclaimer, the term of this patent is extended or adjusted under 35 U.S.C. 154(b) by 444 days.

(21) Appl. No.: 12/387,671

(22) Filed: May 5, 2009

Related U.S. Application Data

(63) Continuation-in-part of application No. 11/904,146, filed on Sep. 26, 2007, now abandoned.

(51) Int. Cl.
*B21D 15/04* (2006.01)

(52) U.S. Cl. ..... 72/106; 72/237

(58) Field of Classification Search ..... 72/105, 72/106, 120, 121, 237, 238, 241.2, 241.6, 72/248, 433, 434, 454, 466.8, 466.9, 243.6, 72/252.5, 208, 241.4
See application file for complete search history.

(56) References Cited

U.S. PATENT DOCUMENTS 3,077,130 A 2/1963 Johnson et al.
3,500,671 A 3/1970 Tadashi Saito et al.
3,541,826 A 11/1970 Halliburton
3,903,722 A 9/1975 Thau, Jr. et al.
3,995,466 A 12/1976 Kunsman
4,041,747 A 8/1977 Elkin
4,166,370 A 9/1979 Goodman
5,079,940 A 1/1992 Pulver et al.
5,528,919 A 6/1996 McGrady et al.
5,778,715 A 7/1998 Lippka et al.
6,272,895 B1 8/2001 Hamm
6,408,664 B1 6/2002 Williams
6,708,545 B1 3/2004 Hamm et al.
6,993,949 B2 2/2006 Dole
2005/0178179 A1* 8/2005 Dole ..... 72/106

* cited by examiner

*Primary Examiner* — Faye Francis
(74) *Attorney, Agent, or Firm* — Gene Scott; Patent Law & Venture Group

(57) ABSTRACT

A roll grooving apparatus has a back-up roller, a grooving roller positioned vertically below the back-up roller, and a linear actuator positioned below the grooving roller. The linear actuator drives the grooving roller linearly toward the backup roller. A drive is coupled to turn the backup roller. A tubular workpiece is mounted with its wall between the two rollers and compressive forces are exerted on the wall as the backup roller rotates, thereby extruding a circular groove in the workpiece.

12 Claims, 3 Drawing Sheets

COMPACT ROLL GROOVING APPARATUS WITH ADJUSTABLE MOUNTING AND EXTENDED BACKUP ROLLER SHAFT

CROSS-REFERENCE TO RELATED APPLICATIONS

This is a Continuation-In-Part application of U.S. patent application Ser. No. 11/904,146, filed Sep. 26, 2007, now abandoned and, which is incorporated herein by reference.

BACKGROUND OF THE INVENTION

1. Field of the Invention

The present invention relates to a roll grooving apparatus, and in particular, to tools that create circumferential grooves in pipes to allow the pipes to be connected together end to end using mechanical couplings.

2. Description of the Prior Art

Mechanical couplings are used to couple pipes to one another by creating a fluid tight joint. It is well known that such couplings are placed in circumferential grooves near the ends of adjoining pipe segments. The grooves are positioned in spaced relation to the ends of the pipe segments and are sized to receive arcuately shaped keys extending from each pipe segment. Engagement of the keys with grooves helps the joint formed by the coupling to maintain rigidity. Assembly of piping networks using mechanical pipe couplings may require that pipe stock be cut to a desired length, the cut pipe segments be reamed to remove burrs and sharp edges, and grooves be formed in both ends of each cut pipe segment. The cut, reamed and grooved pipe segments may then be joined to one another using the couplings.

Forming circumferential grooves in pipes that are made of malleable materials such as plastics, copper, steel and aluminum can be accomplished by cold working the material beyond its yield limit, thereby causing a permanent deformation in the material. Existing techniques for forming circumferential grooves in metal and plastic pipes entail sandwiching the pipe sidewall between the circumferences of two adjacent rotatable rollers. One roller, known as the backup roller, is positioned on the inside of the pipe, and the other, known as the grooving roller, is positioned on the outside in a position opposite the backup roller. The backup roller is concave around its outer circumference and the grooving roller is convex around its outer circumference. With the pipe sidewall between them, the rollers are rotated in opposite directions and are forced toward one another so that they apply pressure to the sidewall as the pipe segment rotates. The grooving surfaces traverse the pipe circumference and cooperate to cold work the sidewall producing a circumferential groove of a desired size and shape. The rollers may move around the pipe, in one version of this machine, or the pipe may rotate about its longitudinal axis and move relatively to stationary, but rotating rollers.

The method using a grooving roller and a back-up roller is effective at forming grooves in pipe walls while maintaining the roundness of the pipe because the pipe sidewall is mutually supported between the rollers and is never subjected to offset compressive loads which would tend to collapse the pipe or force it out of round. Both rollers cooperate to work the pipe sidewall, the grooving roller forming the groove and the back-up roller acting as a die to control the flow of material during cold working and precisely define a groove shape.

Our world-wide research of patent literature resulted in the following references which Applicant considers relevant to the herein described and illustrated invention. However, this prior art does not fairly teach or define the novel subject matter of the present invention, each alone, or in combination.

Dole, U.S. Pat. No. 6,993,949 discloses a pipe grooving tool with a housing on which a back-up roller and a grooving roller are rotatably mounted. The grooving roller is pivotable toward the back-up roller and has a raised tool surface engagable with the outer surface of the pipe. The pipe is positioned with its sidewall between the rollers, and the back-up roller is rotated while the grooving roller is forcibly moved toward the back-up roller. A circumferential groove is formed around the pipe as the rollers traverse its circumference. A power drive shaft connected directly to the back-up roller is provided, the power drive shaft engaging a power drive unit on which the tool is mounted operated under power. A manual drive shaft is connected to the back-up roller through a torque multiplying gear and pinion transmission for manual operation of the tool.

Hamm et al., U.S. Pat. No. 6,708,545 discloses a hydraulically operated roll grooving apparatus comprised of a vertically oriented idler and backup grooving rolls, each rotatable about a corresponding roll axis; a fluid actuator for displacing the idler roll toward the backup roll, a manually operated pump for supplying fluid under pressure to the fluid actuator, and a stabilizer for stabilizing a pipe being roll grooved. The pump and stabilizer are mounted on the same side of the apparatus with respect to the roll axes, and the pump has a vertically oriented major dimension and a pump operating lever including a removable handle.

Williams, U.S. Pat. No. 6,408,664 discloses a cold rolling apparatus which includes a forming roll, so as to apply a forming load to a tube when cold rolling the tube, and a hydraulic positioning assembly, this includes a positioning roller disposable for initial contact with a tube surface and is arranged to apply a positioning load to the tube. A hydraulic circuit is coupled to the forming roll and to the hydraulic positioning assembly such that the positioning load is related to the forming load. A face plate mounted for movement with the forming roll, and the positioning roller is mounted to the face plate. The face plate is coupled to a piston of the hydraulic positioning assembly for movement with the piston relative to the forming roll. The piston is housed within a cylinder body coupled to a guide block which is coupled to the forming roll. The forming roll is an outside roll, and the cold rolling apparatus includes two positioning rollers.

Hamm, U.S. Pat. No. 6,272,895 discloses facilitating a roll grooving apparatus for rolling a circumferential groove in a pipe; which is adapted to be mounted on a power drive unit for the axes of the driven and idler grooving rolls to lie in a plane, which is one of horizontal or at an acute angle to horizontal, such that the weight of a pipe between the grooving rolls, during a roll grooving operation, promotes tracking of the groove. A rotatable groove depth gauge is mounted on a support member of the apparatus adjacent to a stop element which engages the support member to determine groove depth, and the gauge is displaceable relative to the stop element into and out of a gauging position in which the stop element can be set to control the groove depth in a given workpiece.

Lippka, U.S. Pat. No. 5,778,715 discloses a positioning roller assembly, so as to be used when cold rolling a tube, which includes first and second positioning rollers disposed for initial contact with a tube surface, and a mechanism for maintaining contact of the first and second positioning rollers are relative to the tube surface during groove rolling. The first positioning roller is positioned to apply a first initial predetermined load to the tube and the second positioning roller is positioned to apply a second, smaller initial predetermined load to the tube. The mechanism acts on the tube in a manner to equalize the loads to offset the tube during cold rolling. The positioning rollers also apply a downward load to the tube during cold rolling to, e.g., reduce tube end flaring when cold rolling a groove in a steel pipe and stabilize a cold rolling machine when cold rolling outward steps in a copper pipe.

McGrady, U.S. Pat. No. 5,528,919 discloses with an apparatus for roll grooving thin wall pipe which is comprised of a housing so as to support a female drive roll and an arm, which is pivotally mounted on the housing, supports a male idler roll. A feed screw between the housing and arm provides for pivoting the arm to displace the idler roll radially toward and away from the drive roll, and a quick release arrangement between the feed screw and housing is operable to release the arm to displace the idler roll away from the drive roll at the end of a roll grooving operation without rotating the feed screw. Self-tracking during a roll grooving operation is provided by teeth on an outer surface of the drive roll which urge the pipe and grooving rolls axially inwardly relative to one another.

Pulver et al., U.S. Pat. No. 5,079,940 discloses a roll grooving apparatus is pivotally mountable on the support rails of a power drive unit; by which the apparatus is driven, it is comprised of a lower support which includes a drive shaft driven by the power unit and the lower grooving roll, and an upper support member pivotally interconnected with the lower support member and rotatably supporting the upper grooving roll. A lever arm is pivotally mounted on the lower support member and is interengaged with the upper support member through a pin and slot arrangement, whereby pivotal displacement of the lever arm imparts pivotal displacement to the upper support member and thus movement of the upper grooving roll toward and away from the lower grooving roll. The lower support includes a stop which limits displacement of the lever in the direction which moves the upper grooving roll towards the lower grooving roll, thus to assure a desired depth for the groove in a workpiece, and the pivotal interconnection between the upper and lower supports is adjustable to provide for adjusting the groove depth and accommodating different pipe or tube sizes and thicknesses. The adjustment enables using the stop on the lower support member as a constant in connection with pipe size and thickness variables and enables optimizing the leverage advantage and the direction of application of force of the upper grooving roll relative to the lower grooving roll.

Goodman, U.S. Pat. No. 4,166,370 discloses a single electric motor is employed to drive two separate backup roll supporting shafts which are mounted to rotate about a common horizontal axis. A first, solid, cylindrical backup roll of relatively small diameter (less than 1½") is secured to one end of one of said shafts for rotation beneath a first grooving roll, and a second, relatively larger diameter backup roll (greater than 1½" and less than 2"), which is annular in configuration, is secured coaxially to one end of the other shaft for rotation thereby beneath a second grooving roll. Each grooving roll is mounted for vertical reciprocation by springs and by a hydraulic ram supplied by fluid from a separate hand pump. Means is also provided for adjustably limiting the descent of each backup roll.

Elkin, U.S. Pat. No. 4,041,747 discloses an apparatus for grooving pipe extending longitudinally axially is there comprised of: a transversely elongated frame adapted to be displaced transversely relative to the pipe axis, a grooving roller which has an annular boss to swage the groove in the pipe, and a back-up roller which has an annular recess in transverse alignment with said boss, said rollers carried by the frame, and means to bodily and progressively displace one of the rollers relatively toward the other roller to cause the boss to progressively form the groove in the pipe wall being rotated between the rollers, the two rollers being rotated in response to pipe rotation.

Kunsman, U.S. Pat. No. 3,995,466 discloses a machine for semi-automatic grooving of pipe, which is capable of high output of full, or less than full, lengths of pipe with uniform external circumferential grooves; has supporting idler rolls for automatic positioning of the pipe axis at a small angle of deflection to draw the pipe end in as grooving progresses, with respect to a driven backup roll and a freely rotatable grooving roll. Pipe vibration during rotation is damped by hydraulic means. An adjustable groove depth control and a safety mechanism are also provided.

Thau, Jr. et al., U.S. Pat. No. 3,903,722 discloses a tool for rolling external circumferential grooves in pipes by rotating the pipe between a driven backup roll and a freely rotating grooving roll which engages the outer pipe surface. The grooving roll is mounted in a sliding housing and is urged against the pipe wall by a hydraulic cylinder acting along a line substantially perpendicular to the axis of rotation of the grooving roll. The linear motion of the sliding housing is limited by an adjustable depth stop to produce grooves of uniform depth.

Halliburton, U.S. Pat. No. 3,541,826 discloses a device for preparing the ends of lengths of pipe for coupling together, which simultaneously rolls a groove into the pipe wall, which is adjacent to the free end thereof and swages the end circumferentially inwardly.

Saito et al., U.S. Pat. No. 3,500,671 discloses a rolling apparatus for manufacturing rings which is comprised of a pair of inclined rolling rollers, a pair of travelling members respectively supporting the rolling rollers and a roll block supporter carrying a group of rolls on each of its side surfaces. Through the travel of the travelling members, the rolling rollers are adapted to move close to or away from each other. The rolling rollers press a 2g material ring cooperatively with the group of rolls, and a series of rolling operation is continuously performed through the rotation of the roll block supporter which rotates intermittingly every 90 degrees.

Johnson et al., U.S. Pat. No. 3,077,130 discloses this invention relates to rim rolling machines and refers more particularly to a rim rolling machine having a rim edge rolling attachment. The invention provides a rim rolling machine with specially contoured rolls to trim and smooth an edge of the rim blank; it also provides a rim rolling machine which has an attachment for rolling and smoothing an edge of the rim blank during the rim rolling operation and provides a rim rolling machine which has a rim edge rolling attachment that is automatically operated in timed relation with the rolls of the machine to roll an edge of the rim blank during the rim rolling operation.

Unfortunately, conventional roll grooving machines suffer from certain drawbacks. For example, they tend to be bulky, large and heavy causing them to be difficult to use. They tend to be complex machines and many are only useful for a narrow range of pipe diameters. Since pipe segments and tubes tend to be long with only one end engaged in the grooving machine, they must be supported along their length by one or more pipe stands, which is well known and conventional. A drawback of some conventional grooving equipment is that the grooving roller is positioned at the top of the tube to be worked. Therefore, when changing from one pipe diameter to another pipe diameter the vertical height of the pipe stands much be adjusted. The present invention avoids this inconvenience by placing the grooving roller at the bottom of the pipe. In this arrangement, the pipe stands are set for any pipe diameter. Another drawback of conventional grooving machines is that when grooving short pipe segments where no stand is required or necessary, the backup roller, which is inside the pipe does not materially contribute to the alignment of the pipe segment or to holding the pipe segment prior to clamping the pipe wall between the rollers. The presently described grooving machine has an extended length on the backup roller which provides this important enablement making the handling and grooving of short pipes and tubes much more convenient.

SUMMARY OF THE DISCLOSURE AND ADVANTAGES

It is an object of the present invention to provide a roll grooving apparatus which addresses and overcomes the drawbacks of conventional roll grooving machines.

The present invention provides a back-up roller, a grooving roller positioned vertically below the back-up roller, and a hydraulic jack positioned vertically below the grooving roller. With the hydraulic jack exerting an upward force, it drives the grooving roller upwardly toward the back-up roller to form the desired groove in the wall of a pipe segment positioned between these rollers. By positioning the hydraulic jack directly below the grooving roller, pipe segments having almost any diameter can be grooved. This is because the roll grooving nip point is fixed relative to the ground so that pipe support frames which support the workpiece during grooving operations need no vertical adjustment when changing pipe sizes. In contrast, machines that push the grooving roller downwardly require vertical adjustment of pipe supporting stands.

The present invention is compact enabling it to be mounted and operated without removing a conventional carriage frame from the carriage rails of a drive unit. This has the advantage of being able to rest a pipe segment on the carriage frame when placing a pipe segment for grooving. The carriage frame also serves the same purpose when inspecting a finished groove.

The present invention provides a backing roller that has an extensive guide portion which is used to help guide a workpiece into an operating position and is able to support shorter, and smaller diameter pipe sections while the grooving roller is raised into position.

The vertical distance between drive rotational axis and carriage rail position and diameter varies among the drive unit equipments provided by different manufacturers. This usually means that a roll grooving apparatus may only be used with one manufacturer's drive unit. The present invention provides vertical adjustment of its support bars so that it is able to be adapted and used with essentially any conventional drive unit.

DETAILED DESCRIPTION OF THE PREFERRED EMBODIMENTS

The above described drawing figures illustrate the described apparatus and its method of use in at least one of its preferred embodiments, which is further defined in detail in the following description. Those having ordinary skill in the art may be able to make alterations and modifications to what is described herein without departing from its spirit and scope. Therefore, it should be understood that what is illustrated is set forth only for the purposes of example and should not be taken as a limitation on the scope of the present apparatus and its method of use.

Figure 1:
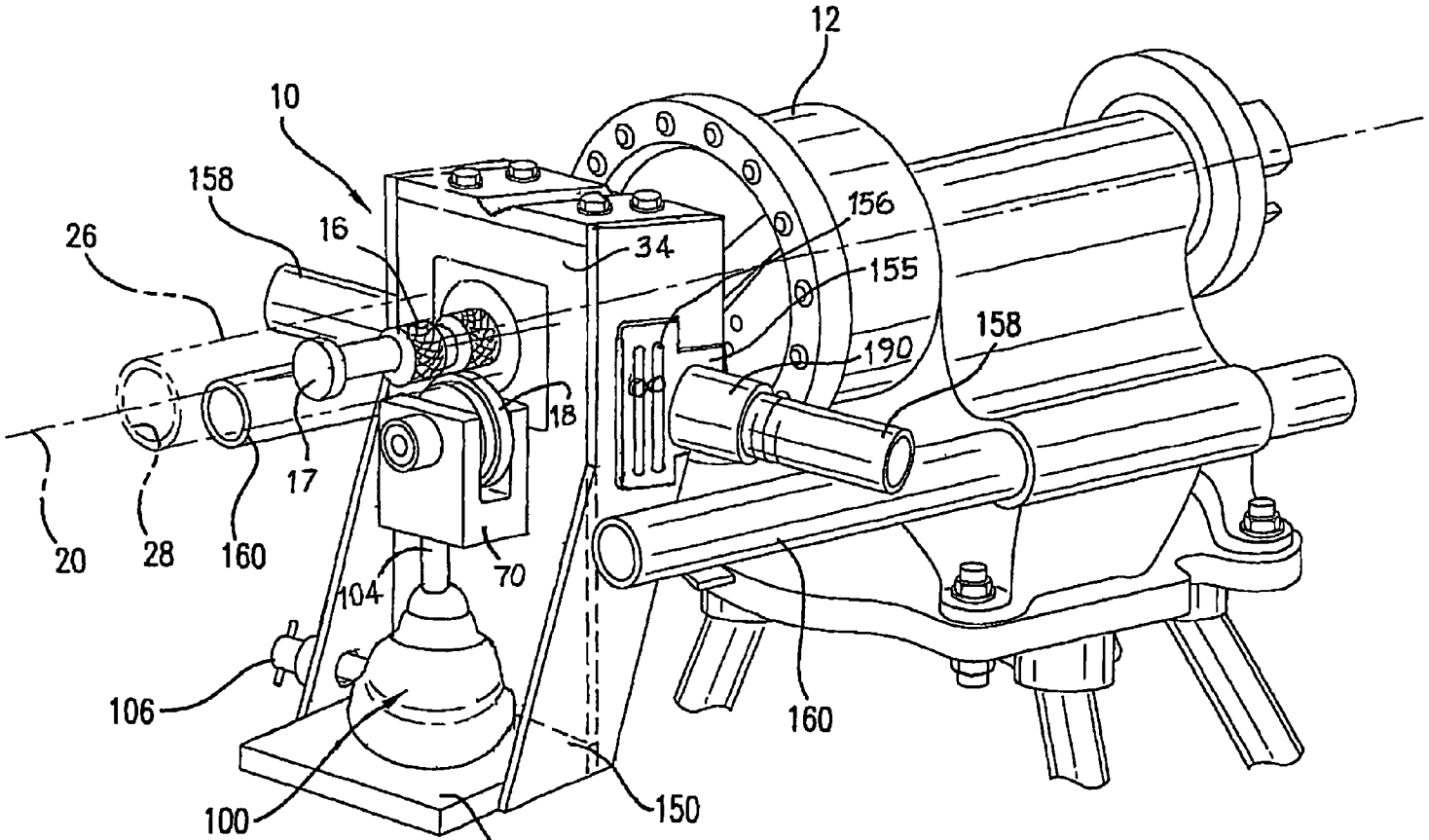
FIG. 1 is a perspective view of a roll grooving apparatus according to the present invention and is shown mounted on a power drive unit with an orientation whereby grooving is conducted at the bottom of a tubular workpiece as the workpiece rotates about its longitudinal axis.
Figure 2:
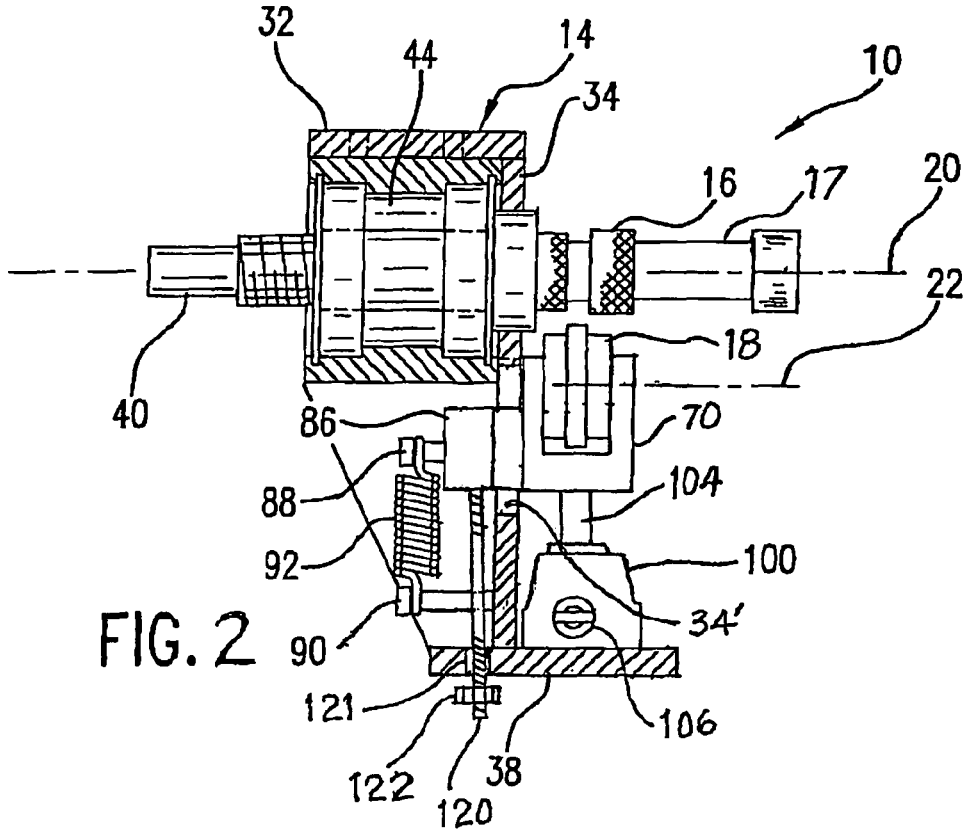
FIG. 2 is a vertical cross section of the roll grooving apparatus showing internal details.
Figure 3:
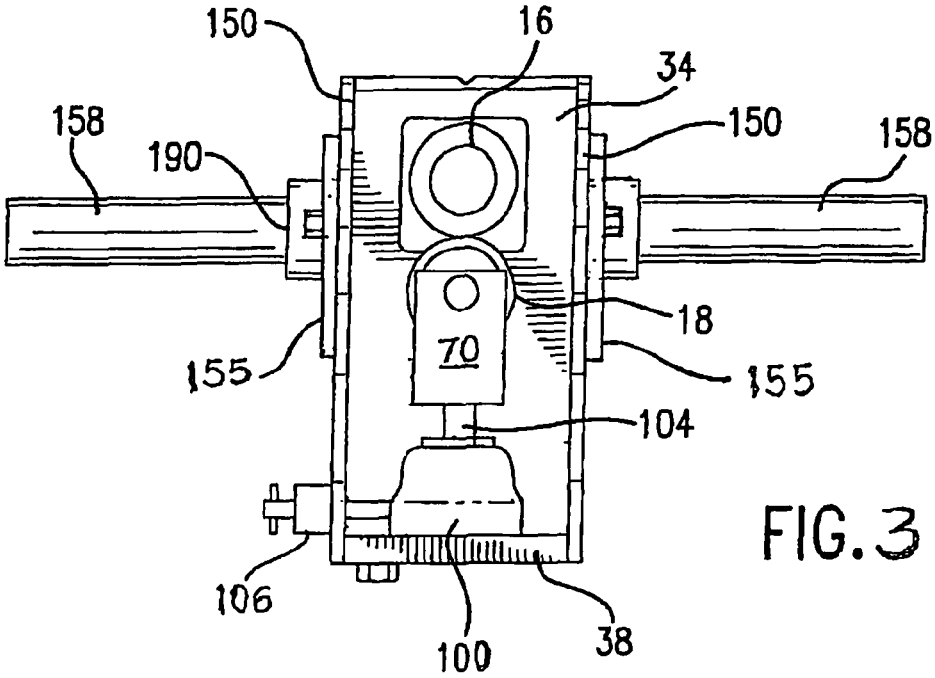
FIG. 3 is a front elevational view thereof.

FIG. 1 shows a roll grooving apparatus 10 according to the present invention. In use, the apparatus is mounted on a power drive unit 12 which is used for producing grooving action. The apparatus 10 does not have rolling power by itself. Referring to FIG. 2, the apparatus 10 has a primary housing 14 on which are mounted a back-up roller 16 and a grooving roller 18. The back-up roller 16 has a rotating axis 20, and the grooving roller 18 has a rotating axis 22. These axes of rotation 20 and 22 are substantially parallel to one another and to the longitudinal axis of a pipe segment 26, shown in phantom line in FIG. 1; segment 26 is the workpiece operated-on by the present apparatus 10. The tubular wall 28 of pipe segment 26 is positioned between the rollers 16 and 18 for forming a circumferential groove. FIG. 3, shows that rollers 16 and 18 are vertically aligned. Back-up roller 16 provides an axial extension 17 which is used for conveniently supporting pipe segment 26 prior to and immediately after clamping the wall 28 of pipe segment 26.

As shown in FIG. 2, the primary housing 14 comprises a horizontal top plate 32, a vertical front plate 34, and a horizontal base plate 38; the base plate 38 extending forward of the front plate 34. Side plates 150 are joined to the top, front and base plates 32, 34 and 38 respectively to form a highly rigid structure as is required for the grooving operations.

As shown in FIG. 2, the back-up roller 16 is part of drive shaft 40 which is engaged with bearing housing 44 mounted integrally with top plate 32 and front plate 34. Drive shaft 40 is rotationally engaged with bearings within bearing housing 44 in a manner well known in the mechanics art. The drive shaft 40 directly turns the back-up roller 16 about axis 20. Drive shaft 40 is engaged with the power drive unit 12 to receive rotational driving force.

As best shown in FIGS. 1 and 3, an adjustment plate 155 is mounted onto the outside of each side plate 150. Plates 155 are a means for adjustment in that they have mounting slots 156 by which they are mounted using a pair of bolts, as shown; the slots 156 comprising a linear means for adjustment. Threaded collars 190, which are a means for securing, are welded or otherwise engaged with plates 155; support bars 158 are threaded into collars 190 so as to be positioned for extending laterally from the primary housing 14. In an alternate preferable arrangement, plates 155 may have threaded holes for threadedly receiving the support bars 158 and in this approach, the threaded collars 190 are not necessary. During operation support bars 158 rest on top of corresponding stationary carriage rails 160 which extend forward from the power drive unit 12. This prevents the primary housing 14 from rotating when torque is applied to the drive shaft 40. It should be noticed that support bars 158 rest on rails 160 but are not otherwise engaged therewith. Clearly, support bars 158 are adjustable over a vertical range so as to adapt the apparatus for different power drive units 12 as is discussed in the summary of this specification.

The grooving roller 18 is rotatably mounted in a U-shaped secondary housing 70 as shown in the figures. Bearings (not shown) are positioned on either side of the grooving roller 18.

As shown in FIG. 2, support plate 86 is secured to, or made integral with, secondary housing 70 though a vertical slot 34' in front plate 34 so that secondary housing 70 is able to slide vertically over a linear range guided by slot 34'. Support plate 86 is spaced apart from secondary housing 70 allowing enough space to permit secondary housing 70 to slide but tight enough to prevent secondary housing 70 from tilting front to back as it moves. Support plate 86 also extends laterally to both sides of slot 34' to prevent secondary housing 70 from being ejected from slot 34'. That portion of support plate 86 that extends through slot 34' from front to back is wide enough, with a sliding clearance, so that secondary housing 70 is not able to twist or tilt from side to side as it moves.

As shown in FIG. 2, bolt 88 extends rearwardly from plate 86 and bolt 90 extends rearwardly also from the rear-facing surface of front plate 34. Compression coil spring 92 is tensioned between bolts 88 and 90 so that it tends to pull secondary housing 70, and with it grooving roller 18, vertically away from backup roller 16. At the same time, piston 104 of linear actuator, hydraulic jack 100, is forced to retract as secondary housing 70 pushes it downwardly, assuming hydraulic pressure release valve 106 is open. This allows the workpiece pipe segment 26 to be removed from between the rollers 16 and 18 when the grooving operation is completed.

Referring to FIG. 3, linear actuator hydraulic jack 100 is rested on the base plate 38, and, as stated, functions to raise the secondary housing 70, and along with it, the grooving roller 18. The hydraulic jack 100 can be embodied in the form of a hydraulic bottle jack, as shown, or any similar device well known in the art. Jack piston 104 extends and retracts along a vertical path and is therefore positioned to drive secondary housing 70 toward backup roller 16 while spring 92 is extended increasing its potential energy. The hydraulic jack 100 is preferably operated manually as is well known.

As shown in FIG. 2, a threaded bar 120 is mounted in a vertical attitude on the rearward side of front plate 34. Bar 120 is secured to plate 86 preferably by thread engagement, and moves vertically with plate 86. Bar 120 moves within clearance hole 121 which is formed in base plate 38 and stop nut 122 is threaded onto the lower end of bar 120 so that at a selected spacing between backup roller 16 and grooving roller 18 stop nut 122 will contact the underside of base plate 38 stopping further vertical movement of grooving roller 18. Stop nut 122 is threadedly positionable on bar 120 so that a selected spacing between rollers 16 and 18 is finely adjustable and easily changed depending on a desired groove depth in the workpiece wall 28.

Figure 4:
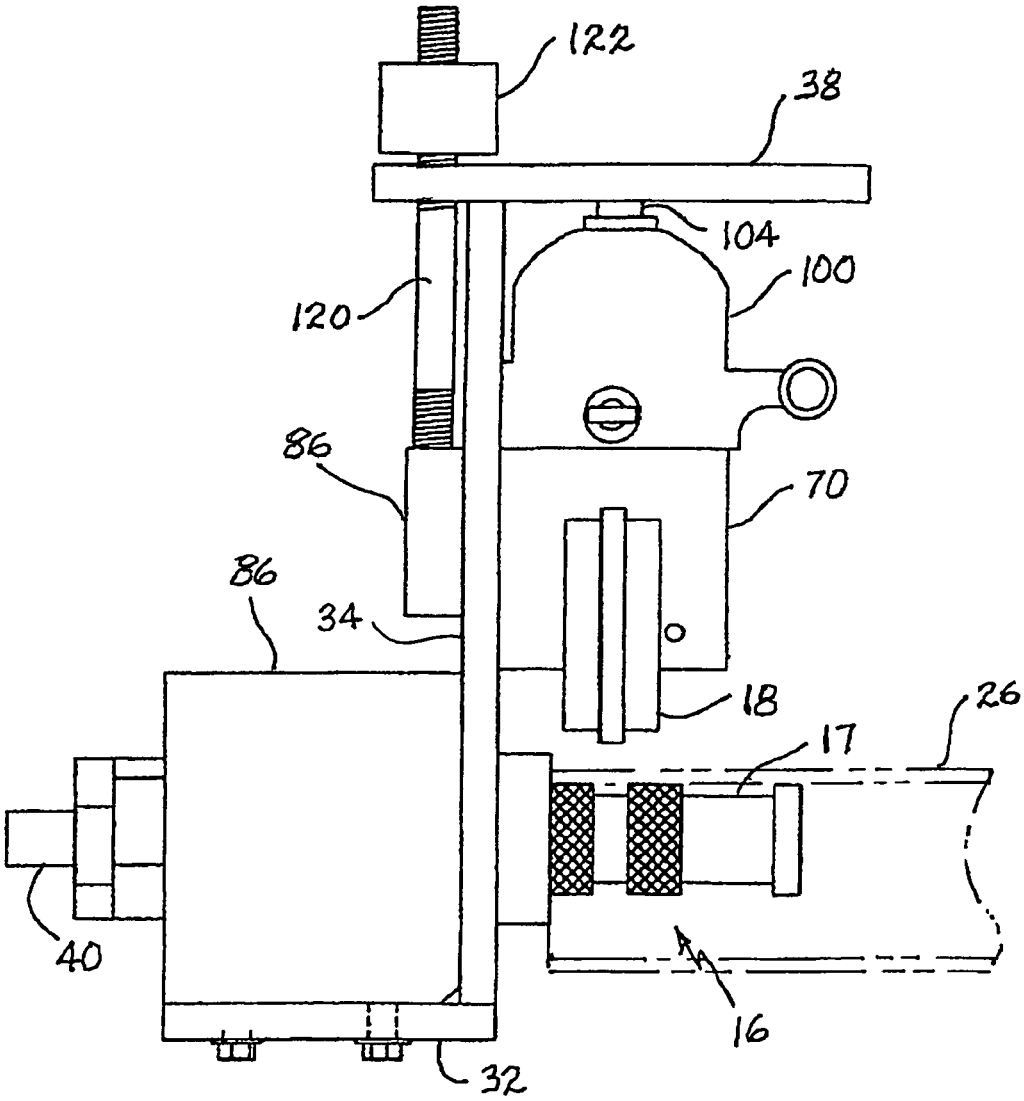
FIG. 4 is a side elevational view thereof shown with side plates removed and in an inverted orientation relative to FIGS. 1-3 for grooving at the top of a tubular workpiece as the workpiece rotates about its longitudinal axis.

As shown in FIG. 4, the primary housing 14 may be inverted when it is desired to position the grooving operation at the top of the tubular workpiece 26.

The enablements described in detail above are considered novel over the prior art of record and are considered critical to the operation of at least one aspect of the apparatus and its method of use and to the achievement of the above described objectives. The words used in this specification to describe the instant embodiments are to be understood not only in the sense of their commonly defined meanings, but to include by special definition in this specification: structure, material or acts beyond the scope of the commonly defined meanings. Thus if an element can be understood in the context of this specification as including more than one meaning, then its use must be understood as being generic to all possible meanings supported by the specification and by the word or words describing the element.

The definitions of the words or drawing elements described herein are meant to include not only the combination of elements which are literally set forth, but all equivalent structure, material or acts for performing substantially the same function in substantially the same way to obtain substantially the same result. In this sense it is therefore contemplated that an equivalent substitution of two or more elements may be made for any one of the elements described and its various embodiments or that a single element may be substituted for two or more elements in a claim.

Changes from the claimed subject matter as viewed by a person with ordinary skill in the art, now known or later devised, are expressly contemplated as being equivalents within the scope intended and its various embodiments. Therefore, obvious substitutions now or later known to one with ordinary skill in the art are defined to be within the scope of the defined elements. This disclosure is thus meant to be understood to include what is specifically illustrated and described above, what is conceptually equivalent, what can be obviously substituted, and also what incorporates the essential ideas.

The scope of this description is to be interpreted only in conjunction with the appended claims and it is made clear, here, that each named inventor believes that the claimed subject matter is what is intended to be patented.

What is claimed is:

1. A roll grooving apparatus for circularly grooving a tubular workpiece, the apparatus comprising:

a backup roller fixedly engaged with a primary housing of the apparatus;

a grooving roller fixedly engaged with a secondary housing, the secondary housing engaged with the primary housing for relative linear motion therewith, said linear motion causing a change in spacing between the backup roller and the grooving roller;

a linear actuator engaged with the primary housing and enabled and positioned for driving the secondary housing with said linear motion;

a support bar engaged with the primary housing through a means for adjustment thereby enabling selective adjustment of a spacing between the backup roller and the support bar; and the backup roller engaged with a driver for rotation of the backup roller;

whereby, the backup roller and the grooving roller compressively engage the tubular workpiece with force applied by the linear actuator, the backup roller driven in rotational motion by the driver, thereby imparting a circular groove in the tubular workpiece.

2. The roll grooving apparatus of claim 1 wherein the linear actuator is enabled for linear extension, and further comprising a compression spring positioned in the apparatus for retraction of the linear actuator.

3. The roll grooving apparatus of claim 1 wherein the backup roller has an axial extension for engaging an interior wall of the tubular workpiece.

4. The roll grooving apparatus of claim 1 wherein the means for adjustment is an adjustment plate secured to the primary housing with linear adjustment means enabling the to adjustment plate to be selectively positioned, the adjustment plate providing a means for securing the support bar thereto.

5. The roll grooving apparatus of claim 1 further comprising a means for limiting said linear extension.

6. The roll grooving apparatus of claim 5 wherein the limiting means comprises a threaded bar secured for moving in accordance with the linear extension, the threaded bar providing a threadedly positionable stop nut, said nut engaging the primary housing when the linear extension has enabled a selected spacing between the backup roller and the grooving roller.

7. A roll grooving apparatus for circularly grooving a tubular workpiece, the apparatus comprising:

a backup roller fixedly engaged with a primary housing of the apparatus;

a grooving roller fixedly engaged with a secondary housing, the secondary housing engaged with the primary housing for relative linear motion therewith, said linear motion causing a change in spacing between the backup roller and the grooving roller;

a linear actuator engaged with the primary housing and enabled and positioned for driving the secondary housing with said linear motion;

a pair of spaced-apart and coaxially oriented, position-adjustable, support bars engaged with the primary housing and extending from opposing sides thereof;

a driver providing carriage rails upon which the support bars rest thereby positioning the primary housing such that the backup roller is coaxially oriented with the driver;

whereby, the backup roller and the grooving roller compressively engage the tubular workpiece with force applied by the linear actuator, the backup roller driven in rotational motion by the driver, thereby imparting a circular groove into the tubular workpiece.

8. The roll grooving apparatus of claim 7 wherein the linear actuator is enabled for linear extension, and further comprising a compression spring positioned in the apparatus for retraction of the linear actuator.

9. The roll grooving apparatus of claim 7 wherein the backup roller has an axial extension for engaging an interior wall of the tubular workpiece.

10. The roll grooving apparatus of claim 7 wherein the means for adjustment is an adjustment plate secured to the primary housing with linear adjustment means enabling the adjustment plate to be selectively positioned, the adjustment plate providing a means for securing the support bar thereto.

11. The roll grooving apparatus of claim 7 further comprising a means for limiting said linear extension.

12. The roll grooving apparatus of claim 11 wherein the limiting means comprises a threaded bar secured for moving in accordance with the linear extension, the threaded bar providing a threadedly positionable stop nut, said nut engaging the primary housing when the linear extension has enabled a selected spacing between the backup roller and the grooving roller.

* * * * *